US008651598B2

(12) United States Patent
Go et al.

(10) Patent No.: US 8,651,598 B2
(45) Date of Patent: Feb. 18, 2014

(54) ACCOMMODATION CONTAINER AND REFRIGERATOR HAVING THE SAME

(75) Inventors: Hyoung Min Go, Gwangju (KR); Sang Bum Kim, Gwangju (KR); Hyun Sang Yoo, Gwangju (KR); Man Soon Im, Gwangju (KR); Sang Woon Jeon, Namyangju-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/600,882

(22) Filed: Aug. 31, 2012

(65) Prior Publication Data

US 2013/0056477 A1 Mar. 7, 2013

(30) Foreign Application Priority Data

Sep. 2, 2011 (KR) ..... 10-2011-0089200

(51) Int. Cl.
*A47B 96/04* (2006.01)

(52) U.S. Cl.
USPC ..... 312/404

(58) Field of Classification Search
USPC ..... 312/401, 402, 404, 408, 330.1, 291, 312/348.3, 283, 286
See application file for complete search history.

(56) References Cited

U.S. PATENT DOCUMENTS

| | | | | | |
|---|---|---|---|---|---|
| 1,614,507 | A | * | 1/1927 | Vogt | 312/408 |
| 1,964,831 | A | * | 7/1934 | Rein | 312/408 |
| 2,146,707 | A | * | 2/1939 | Bangert | 312/292 |
| 2,266,857 | A | * | 12/1941 | Field | 312/303 |
| 4,317,607 | A | * | 3/1982 | Gomolka | 312/236 |
| 4,732,430 | A | * | 3/1988 | Byrns | 312/330.1 |
| D669,921 | S | * | 10/2012 | Kinser | D15/89 |
| 8,382,218 | B2 | * | 2/2013 | Placke et al. | 312/404 |
| 2004/0263031 | A1 | * | 12/2004 | Irizarry | 312/330.1 |
| 2007/0169505 | A1 | * | 7/2007 | Kim et al. | 62/441 |

FOREIGN PATENT DOCUMENTS

KR 10-2011-0080358 7/2011

* cited by examiner

*Primary Examiner* — Darnell Jayne
*Assistant Examiner* — Timothy M Ayres
(74) *Attorney, Agent, or Firm* — Staas & Halsey LLP

(57) ABSTRACT

A refrigerator capable of preventing a cool air from being released when a door is open by having an accommodation container, including a bottom wall, a front side wall, a rear side wall, and lateral side walls to form an accommodation space, stored in a storage compartment together with a food storage container while accommodating the food storage container, the lateral side walls being spaced from the food storage container to form a space that allows a cool air to remain around the food storage container, the front side wall having a height corresponding to a height of the food storage container to prevent the cool air around the food storage container from being released, and the rear side wall and the lateral side walls having heights lower than the height of the front side wall to allow the cool air to flow around the food storage container.

16 Claims, 10 Drawing Sheets

ACCOMMODATION CONTAINER AND REFRIGERATOR HAVING THE SAME

CROSS-REFERENCE TO RELATED APPLICATIONS

This application claims the priority benefit of Korean Patent Application No. 10-2011-0089200, filed on Sep. 2, 2011 in the Korean Intellectual Property Office, the disclosure of which is incorporated herein by reference.

BACKGROUND

1. Field

Embodiments of the present disclosure relate to an accommodation container and a refrigerator having the same.

2. Description of the Related Art

A refrigerator is an apparatus which is provided with a storage compartment and a cool air supply apparatus configured to supply the storage compartment with a cool air. The temperature of the storage compartment is maintained within a predetermined range suitable for keeping foods fresh.

A front surface of the storage compartment is configured to be open, and the front surface open is closed by a door to keep the storage compartment at a predetermined temperature at normal times. The door, however, needs to be open when the food is to be stored or the food stored in the storage compartment needs to be taken out. At this time, the cool air in the storage compartment is released to the outside, thereby increasing the temperature in the storage compartment.

Even if the time of the storage compartment staying out of the predetermined range of temperature is short, for example, when a user opens the door to get beverages from the storage compartment, such a change in temperature of the storage compartment by opening and closing the door, may adversely effect on the state of the food reserved.

For a refrigerator configured to store foods, such as kimchi, vegetables and fish, which are sensitive to the change in temperature, in order to prevent cool air from being released when the door is open, a cool air cover is installed at a front surface of the storage compartment. An example of such a refrigerator is disclosed in the Korean Patent Publication No. 10-2011-0080358.

The refrigerator disclosed is provided with a cool air cover, which is rotated toward a front side of the refrigerator, and thus is not suitable to be applied to a large-size refrigerator having a pair of doors. In addition, even in a case that only one of a plurality of accommodation containers needs to be inserted or withdrawn into/from the storage compartment, the entire cover needs to be open.

SUMMARY

Therefore, it is an aspect of the present disclosure to provide an accommodation container capable of accommodating a food storage container in a manner to minimize the release of a cool air when a door is open, and a refrigerator having the same.

It is another aspect of the present disclosure to provide an accommodation container facilitating inserting/withdrawing a food storage container configured to reserve foods with respect to a storage compartment, and a refrigerator having the same.

Additional aspects of the disclosure will be set forth in part in the description which follows and, in part, will be apparent from the description, or may be learned by practice of the disclosure.

In accordance with an aspect of the present disclosure, a refrigerator includes a body, a storage compartment, a door, a food storage container, and an accommodation container. The body has an inner case and an outer case. The storage compartment is provided inside the body and including an open front surface. The door is rotatably coupled to the body to open and close the open front surface. The food storage container is provided in a box shape to store food therein. The accommodation container is accommodated in the storage compartment together with the food storage container while accommodating the food storage container. The accommodation container includes an accommodation space having an upper surface open, a bottom wall, a front side wall, a rear side wall, a left side wall and a right side wall. The bottom wall, the front side wall, the rear side wall, the left side wall, and the right side wall integrally formed with one another while forming the accommodating space. The front side wall, the rear side wall, the left side wall, and the right side wall are spaced apart from the food storage container to form a space that allows a cool air to remain around the food storage container. The front side wall has a height corresponding to a height of the food storage container to prevent the cool air around the food storage container from being released to a front side of the refrigerator, and the rear side wall, the left side wall, and the right side wall have heights lower than the height of the front side wall to allow the cool air to flow around the food storage container.

The accommodation container further includes a handle part that is formed at each of the front side wall and the rear side wall in an integral body with the accommodation container to insert and withdraw the accommodation container from the storage compartment.

The handle part includes an opening that connects the accommodation space to an outer side of the accommodation container, a first protrusion part protruding toward the accommodation space from an upper side of the opening, and a second protrusion part protruding toward the accommodation space from a lower side of the opening while having a protrusion length larger than a protrusion length of the first protrusion part.

The accommodation container further comprises a lateral side protrusion part that protrudes from each of the left side wall and the right side wall toward the accommodation space to space the food storage container apart from the left side wall and the right side wall, the lateral side protrusion part integrally formed with the accommodation container.

The storage compartment is divided into a plurality of partitions by at least one shelf disposed inside the storage compartment, the accommodation container, which is provided in plurality, is stored side by side in at least one of the plurality of partitions of the storage compartment, and the accommodation container further comprises a space maintaining part that protrudes outward from the left side wall and the right side wall to maintain an interval among the plurality of accommodation containers, the space maintaining part integrally formed with the accommodation container.

The refrigerator further includes an outlet that is formed at a rear side of the inner case of the storage compartment to discharge the cool air into the storage compartment, wherein the outlet is configured to discharge the cool air to an upper side of the accommodation container such that the air uniformly moves around the accommodation container by a convection.

The accommodation container has the front side wall disposed to face the open front surface of the storage compartment while having the rear side wall disposed to face a rear surface of the storage compartment such that the cool air is prevented from being released to the front side of the accommodation container, or the accommodation container has the front side wall disposed to face the rear surface of the storage compartment while having the rear side wall disposed to face the open front surface of the storage compartment to enable an easy access to the accommodation space of the accommodation container.

The door includes a left side door and a right side door.

The accommodation container is formed using transparent material or semi-transparent material.

The accommodation container is formed through an injection molding.

In accordance with another aspect of the present disclosure, a refrigerator includes a body, a storage compartment, at least one shelf, a door, an accommodation container and a plurality of outlets. The body has an inner case and an outer case. The storage compartment is provided inside the body and has a front surface open. At least one shelf is disposed in the storage compartment to divide the storage compartment into a plurality of partitions. The door is rotatably coupled to the body to open and close the front surface of the storage compartment. The accommodation container is stored in the plurality of partitions of the storage compartment. The plurality of outlets is provided at a rear side of the inner case of the storage compartment to discharge a cool air into each of the plurality of partitions, the outlet disposed at an upper side of each of the plurality of partitions such that the cool is discharged to an upper side of the accommodation container.

The accommodation container is provided in a shape of a box having an accommodation space, an upper surface of which is open.

The accommodation container includes a bottom wall, a front side wall, a rear side wall, and lateral side walls that form the accommodation space. The front side wall has a height larger than heights of the rear side wall and the lateral side walls.

In accordance with another aspect of the present disclosure, a refrigerator includes a body, a storage compartment, a door and an accommodation container. The body has an inner case and an outer case. The storage compartment is provided inside the body and has a front surface open, and divided by at least one shelf into a plurality of partitions each having a predetermined height. The door is rotatably coupled to the body to open and close the front surface of the storage compartment. The accommodation container is configured to be stored in one of the plurality of partitions of the storage compartment. The accommodation container includes an accommodation space having an upper surface open, a bottom wall, a front side wall, a rear side wall, and lateral side walls. The bottom wall, the front side wall, the rear side wall, and the lateral side walls form the accommodation space. The front side wall has a height corresponding to the predetermined height of the plurality of partitions, and the rear side wall and the lateral side walls have a height smaller than the height of the front side wall.

The height of the front side wall is larger than a half of the predetermined height of the plurality of partitions.

The height of the rear wall and the heights of the lateral side walls are smaller than a half of the predetermined height of the plurality of partitions.

In accordance with another aspect of the present disclosure, an accommodation container, which is provided with an accommodation space having an upper surface open, a bottom wall, a front side wall, a rear side wall, and lateral side walls, which are integrally formed with one another while forming the accommodation space, includes a handle part. The handle part is formed at each of the front side wall and the rear side wall as an integral body with the accommodation container to move the accommodation container. The front side wall has a height larger than heights of the rear side wall and the lateral side walls to prevent a cool air in the accommodation space from being released to a front side of the accommodation container.

The handle part includes an opening that connects the accommodation space to an outer side of the accommodation container, a first protrusion part protruding toward the accommodation space from an upper side of the opening, and a second protrusion part protruding toward the accommodation space from a lower side of the opening while having a protrusion length larger than a protrusion length of the first protrusion part.

The accommodation container further includes a lateral side protrusion part that protrudes toward the accommodation space from the lateral side walls while being integrally formed with the accommodation container.

The accommodation container further includes a space maintaining part that protrudes from the lateral side walls while being integrally formed with the accommodation container.

According to the refrigerator according to embodiments of the present disclosure, a cool air in a storage compartment is prevented from being released when a door is open.

In addition, a cover structure installed at a front surface of a storage compartment is omitted, thereby improving the accessibility to a food storage container and an accommodation container that are stored in the storage compartment.

In addition, a front side and a rear side of the accommodation container are reversed such that a rear wall having a lower height is disposed at a front side of the storage compartment, thereby improving the convenience in reserving a certain food that is needed for a frequent access.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
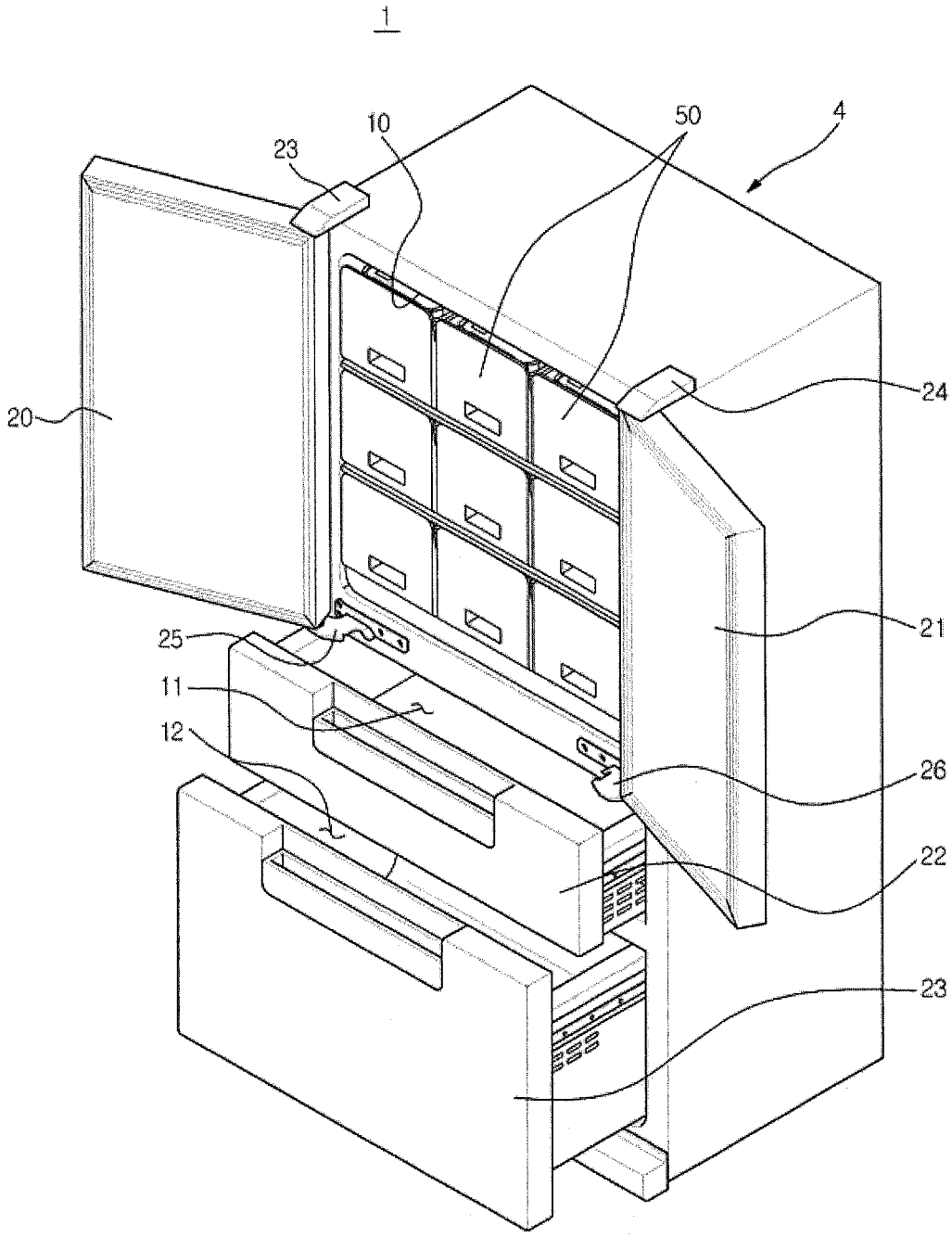
FIG. 1 is a perspective view illustrating the exterior of a refrigerator according to an embodiment of the present disclosure.

Reference will now be made in detail to embodiments of the present disclosure, examples of which are illustrated in the accompanying drawings, wherein like reference numerals refer to like elements throughout.

Figure 2:
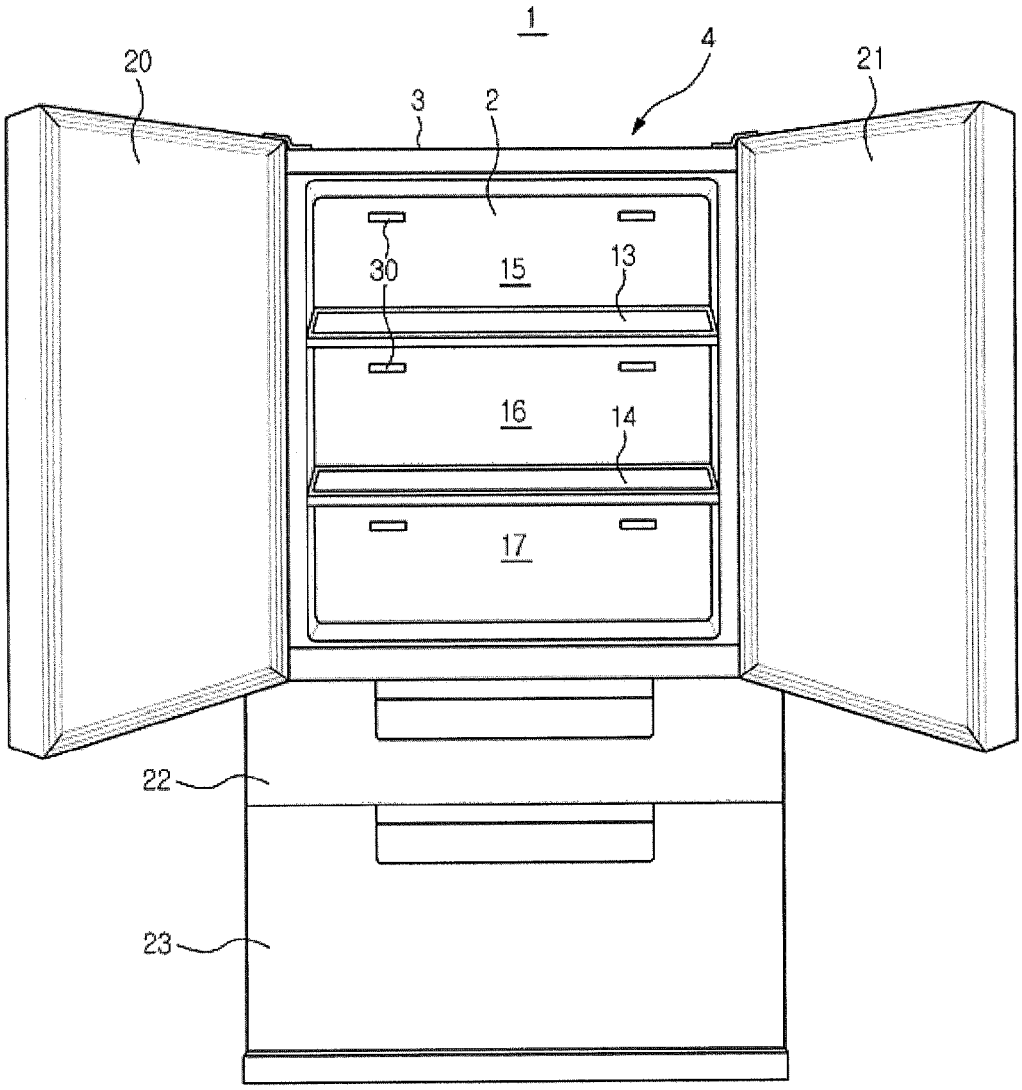
FIG. 2 is a front side view illustrating a state of a food storage container and an accommodation container being withdrawn from the refrigerator of FIG. 1.

FIG. 1 is a perspective view illustrating the exterior of a refrigerator according to an embodiment of the present disclosure. FIG. 2 is a front side view illustrating a state of a food storage container and an accommodation container being withdrawn from the refrigerator of FIG. 1.

Referring to FIGS. 1 and 2, a refrigerator 1 according to an embodiment of the present disclosure includes a body 4, including an inner case 2 forming storage compartments 10, 11, and 12, and an outer case 3 forming an exterior of the refrigerator 1, and a cool air supply apparatus (not shown) configured to supply the storage compartments 10, 11, and 12 with a cool air.

The cool air supply apparatus includes a compressor, a condenser, an expansion valve, an evaporator, a blower fan, and a cool air duct. An insulating material (not shown) is foamed between the inner case 2 and the outer case 3 to prevent a cool air of the storage compartments 10, 11, and 12 from being released.

The storage compartments 10, 11, and 12 are sequentially classified into an upper compartment 10, a middle compartment 11, and a lower compartment 12. Each of the storage compartments 10, 11, and 12 is used to keep foods cool or freezing as necessary. In addition, a heater apparatus (not shown) may be provided in the upper compartment 10 and the middle compartment 11 to mature the foods stored therein.

Meanwhile, the middle compartment 11 and the lower compartment 12 are provided at an inner side of a middle drawer 22 and a lower drawer 23, respectively, which are slidable with respect to the body 4, while being integrally formed with the middle drawer 22 and the lower drawer 23, respectively. The upper compartment 10 has a front surface that is able to be open, and the open front surface may be open/closed by doors 20 and 21 which are rotatably coupled to the body 4.

The upper compartment 10 is provided with a large width thereof to provide a high capacity of storage. Accordingly, a pair of doors including a left side door 20 and a right side door 21 is provided to cover the front surface of the upper compartment 10. The left side door 20 is rotatably coupled to the body 4 through upper hinges 23 and 24, and the right side door 21 is rotatably coupled to the body 4 through lower hinges 25 and 26.

In addition, at least one shelf 13 and 14 is provided on the upper compartment 10 such that the upper compartment 10 is divided into a plurality of partitions 15, 16, and 17. Each of the plurality of partitions 15, 16, and 17 has an approximately identical height. An outlet 30 configured to discharge a cool air is additionally provided in each of the plurality of partitions 15, 16, and 17.

The outlet 30 may be disposed at a position suitable for discharging a cool air to an upper side of an accommodation container 50, which is to be described later with reference to FIG. 9. Accordingly, the cool air, which moves to a lower side through convection, is able to equally cool each of the partitions 15, 16, and 17, each of accommodation containers 50, and each food storage container 40 accommodated in each accommodation container 50. Herein, the food storage container (40, in FIG. 4) is designed to store kimchi, vegetables and fish at an air tightness state. Detailed description will be made later.

In FIG. 1, the plurality of accommodation containers 50 is stored in each of the partitions 15, 16, and 17 side by side. According to the illustration of FIG. 1, the upper compartment 10 is divided into three partitions 15, 16, and 17, and three accommodation containers 50 are stored in the three partitions 15, 16, and 17, respectively. However, the number of partitions divided is not limited thereto, and may vary depending on design.

Figure 3:
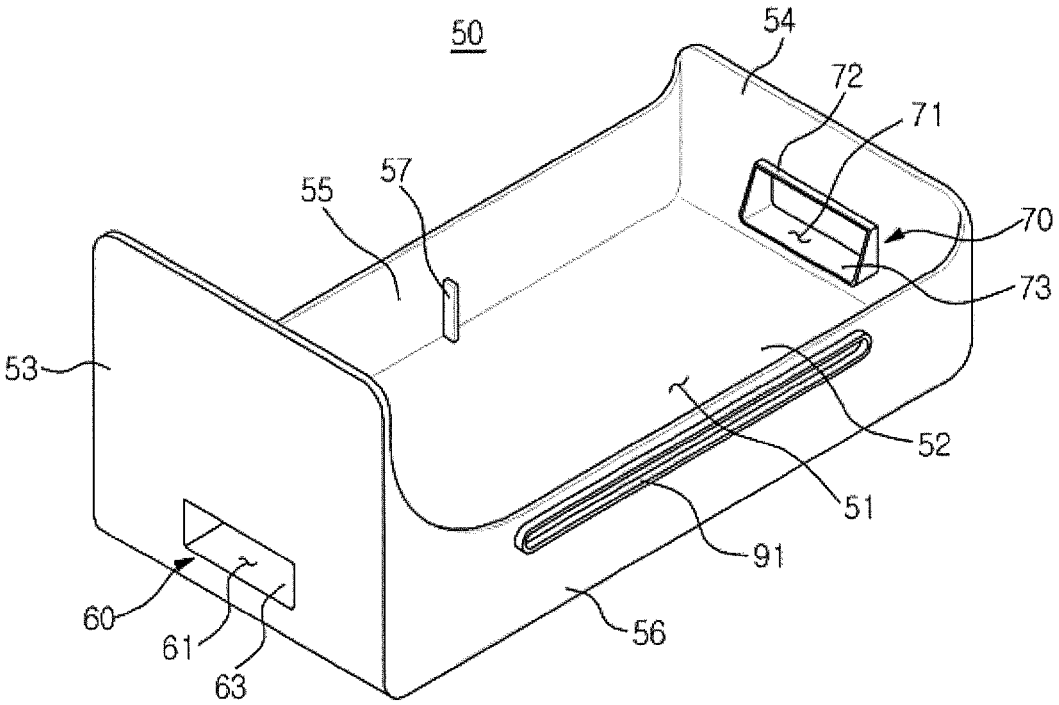
FIG. 3 is a perspective view illustrating the accommodation container of the refrigerator of FIG. 1.
Figure 4:
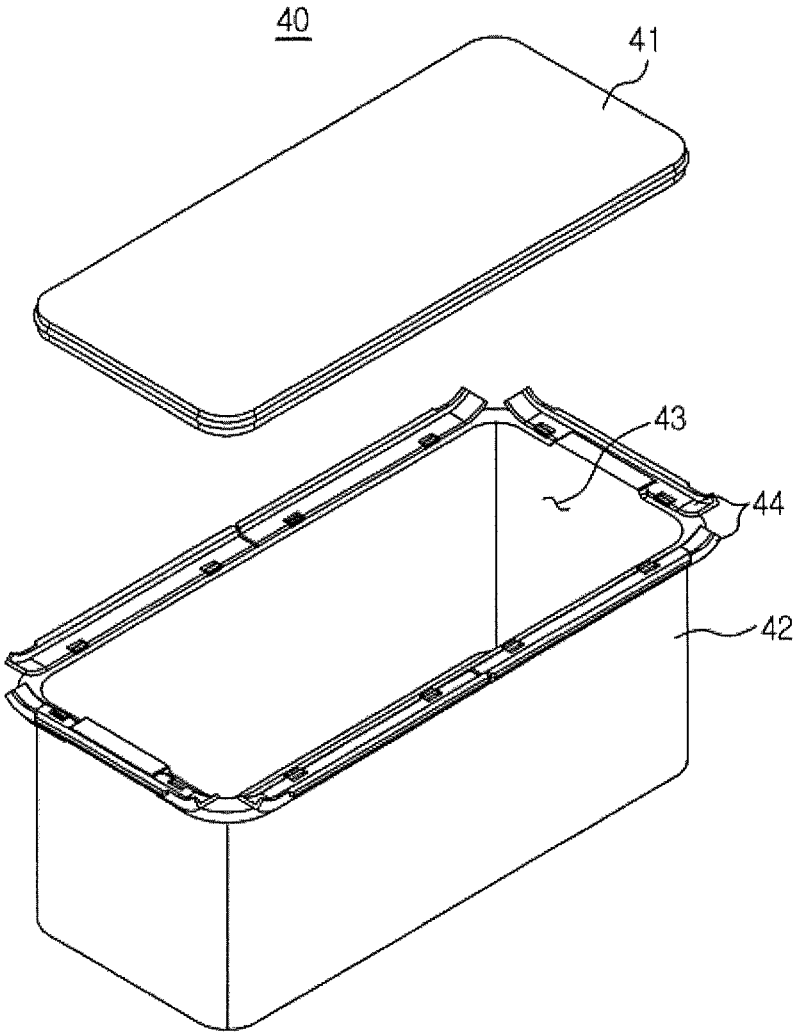
FIG. 4 is a perspective view illustrating the food storage container of the refrigerator of FIG. 1.
Figure 5:
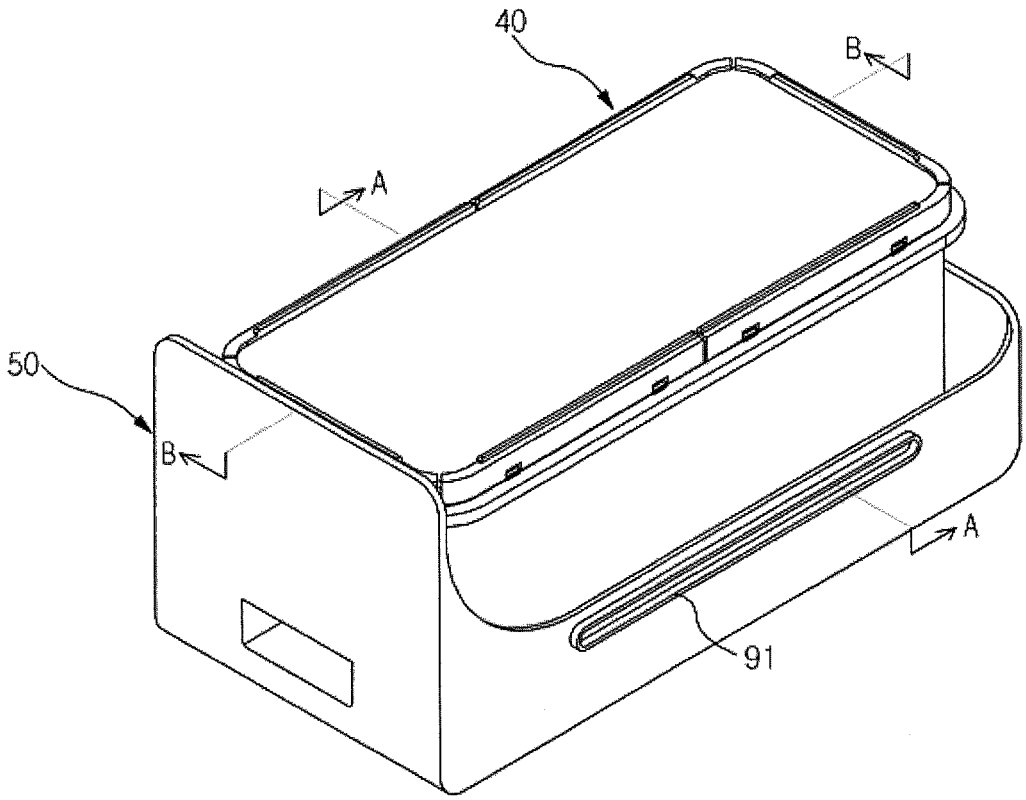
FIG. 5 is a perspective view illustrating a state of the food storage container of FIG. 4 being accommodated in the accommodation container of FIG. 3.
Figure 6:
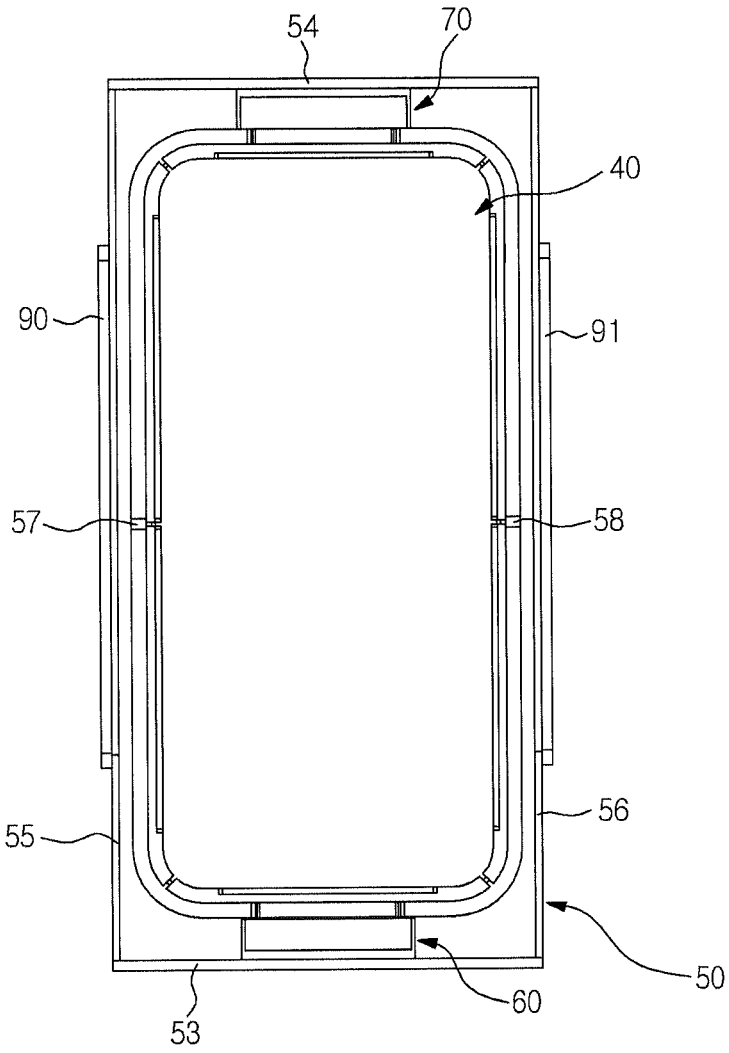
FIG. 6 is a plane view illustrating a state of the food storage container of FIG. 4 being accommodated in the accommodation container of FIG. 3.
Figure 7:
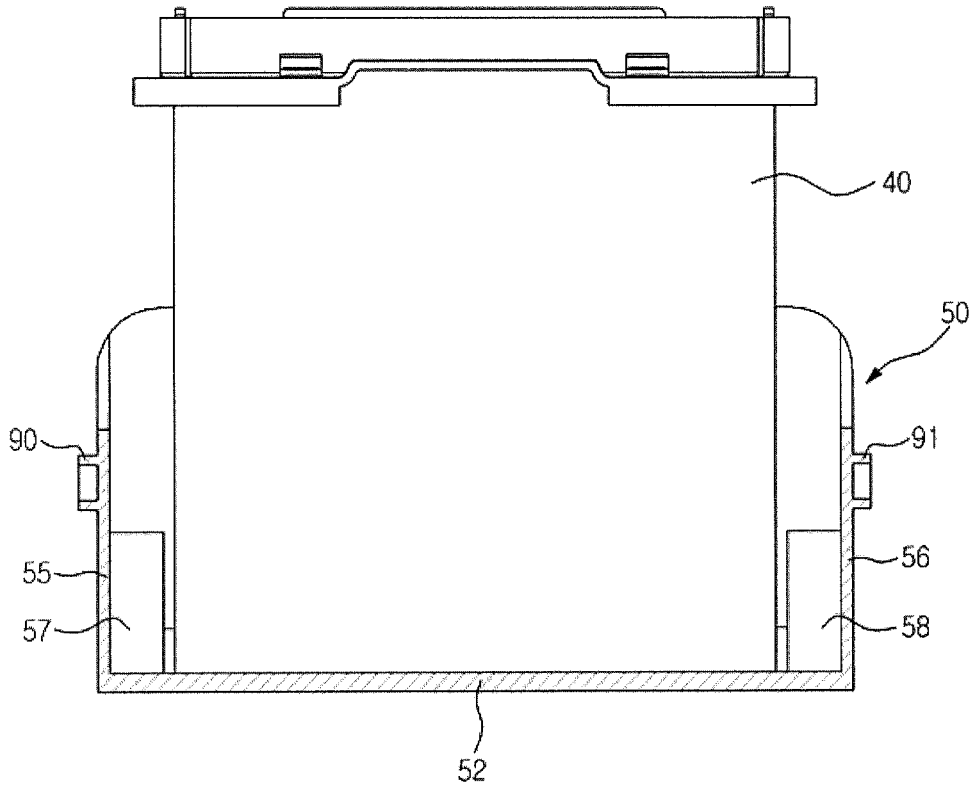
FIG. 7 is a cross sectional view taken along line A-A of FIG. 5.
Figure 8:
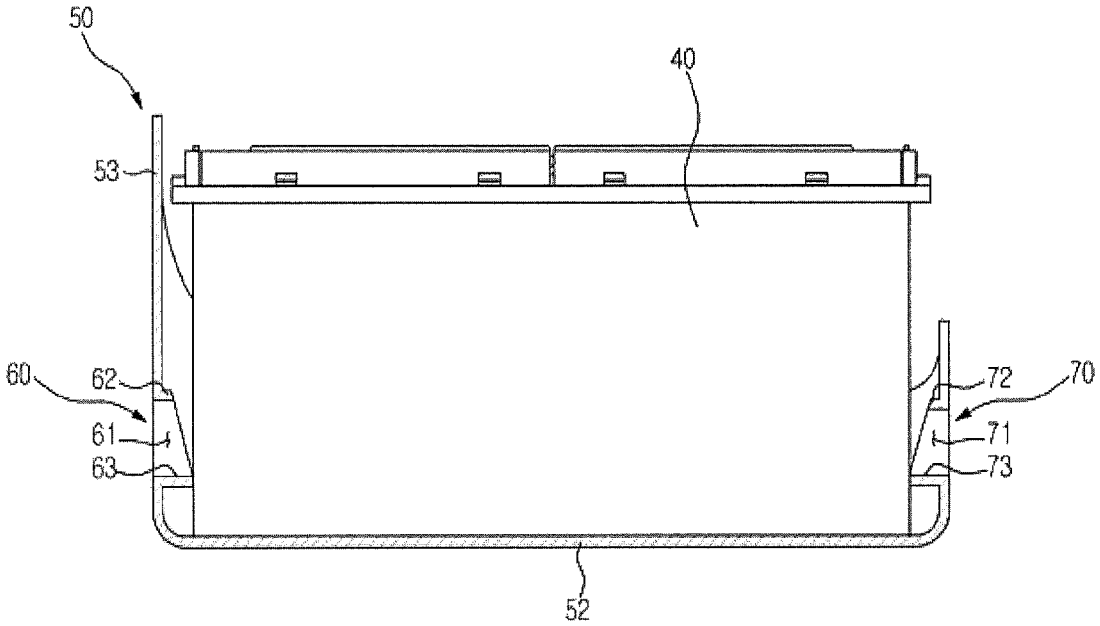
FIG. 8 is a cross-sectional view taken along line B-B of FIG. 5.

FIG. 3 is a perspective view illustrating the accommodation container of the refrigerator of FIG. 1. FIG. 4 is a perspective view illustrating the food storage container of the refrigerator of FIG. 1. FIG. 5 is a perspective view illustrating a state of the food storage container of FIG. 4 being accommodated in the accommodation container of FIG. 3. FIG. 6 is a plane view illustrating a state of the food storage container of FIG. 4 being accommodated in the accommodation container of FIG. 3. FIG. 7 is a cross-sectional view taken along line A-A of FIG. 5. FIG. 8 is a cross-sectional view taken along line B-B of FIG. 5. FIG. 9 is a view illustrating a first example of the accommodation container according to an embodiment of the present disclosure. FIG. 10 is a view illustrating a second example of the accommodation container according to an embodiment of the present disclosure.

Hereinafter, the food storage container 40 and the accommodation containers 50 of the refrigerator according to an embodiment of the present disclosure will be described in detail with reference to FIGS. 3 and 10.

The food storage container 40 is designed to store kimchi, vegetables and fish at a sealed state. Referring to FIG. 4, the food storage container 40 includes a body 42, which is provided in a shape of a box having an upper surface open, and a cover 41 configured to open and close the upper surface of the body 42.

A storage space 43 is formed inside the body 42 to store foods. The cover 41 is fixed to the upper surface of the body 42 through a plurality of lockers 44 that is rotatably coupled to the body 42. The food storage container 40 as such may be formed through an injection molding, and may be implemented using a Tupperware product.

Each of the accommodation containers 50 may be stored in the storage compartments 10, 11, and 12 together with the food storage container 40 while accommodating the food storage container 40. Alternatively, the accommodation containers 50 may directly accommodate foods without the food storage container 40 accommodating foods. Referring to FIG. 9, the food storage container 40, while being accommodated in each of the accommodation containers 50, is stored in the storage compartment 10. Referring to FIG. 10, canned foods or bottled foods are stored in the storage compartment 10 while being accommodated in each of the accommodation containers 50 other than in the food storage container 40.

Each of the accommodating containers 50 is provided in a shape of a box, for example, having an accommodation space, an upper surface of which is open. The accommodation space 51 may have a size larger than the food storage container 40 to be suitable for accommodating the food storage container 40.

Each of the accommodation containers 50 is formed through an injection molding as an integral body. The accommodation containers 50 may be formed using transparent material or semi-transparent material to be suitable for checking the contents stored in the accommodation containers 50 from the outside.

Each of the accommodation containers 50 includes a bottom wall 52, a front side wall 53, a rear side wall 54, a left side wall 55, and a right side wall 56. The front side wall 53, the rear side wall 54, the left side wall 55, and the right side wall 56 are vertically extended from the bottom wall 52 to maximize the size of the accommodation space 51.

In addition, the front surface 53 of each of the accommodation containers 50 is provided to have a height larger than the heights of the left side wall 55, the right side wall 56, and the rear side wall 54. In this manner, a cool air in the accommodation space 51 is prevented from being released to a front side of the accommodation containers 50.

In this case, the front side wall 53 may be provided to have a height approximately corresponding to the height the food storage container 40 accommodated. In addition, according to another aspect of the present disclosure, the front side wall 53 may be provided to have a height approximately corresponding to the height of the plurality of partitions 15, 16, and 17 of the storage compartment 10, which are divided by the shelves 13 and 14.

The height of the front side wall 53 of each of the accommodation containers 50 is provided to be larger than a half of the height of the plurality of partitions 15, 16, and 17. The heights of the rear side wall 54, the left side wall 55, and the right side wall 56 of each of the accommodation containers 50 are provided to be smaller than the half of the height of the plurality of partitions 15, 16, and 17.

Accordingly, the cool air is introduced or discharged with respect to the accommodation space 51 through a rear side and a lateral side of each of the accommodation containers 50 without flowing to the front side thereof.

Referring to FIG. 6, each of the accommodation containers 50 is formed such that the food storage container 40 is spaced apart from the front side wall 53, the rear side wall 54, the left side wall 55, and the right side wall 56 in a state of being accommodated in the accommodation space 51. Accordingly, a space is provided between the food storage container 40 and each of the front side wall 53, the rear side wall, the left side wall 55, and the right side wall 56, and a cool air remains in the space. As such, the food storage container 40 directly makes contact with the cool air in front/rear/left and right directions, and is equally cooled.

In particular, handle parts 60 and 70 of each of the accommodation containers 50 are protruded from the front side wall 53 and the rear side wall 54 of each of the accommodation containers 50 toward the accommodation space 51, and in turn, the food storage container 40 is spaced apart from the front side wall 53 and the rear side wall 54 of each of the accommodation containers 50.

In addition, each of the accommodation containers 50 includes lateral side protrusions 57 and 58 protruded from the left side wall 55 and the right side wall 56, respectively, toward the accommodation space 51 such that the food storage container 40 is spaced apart from the left side wall 55 and the right side wall 56. The lateral side protrusions 57 and 58 are integrally formed with each of the accommodation containers 50. Such a structure forms a space between the food storage container 40 and each of the left side wall 55 and the right side wall 56, where a cool air stays.

In addition, the front side wall 53 and the rear side wall 54 are provided with handle parts 60 and 70, respectively, to insert/withdraw each of the accommodation containers 50 into/from the storage compartment 10. Since the handle part 60 provided at the front side wall 53 has the same shape and configuration as that of the handle part 70 provided at the rear side wall 54, detailed description will be made in relation to the handle part 60, and the handle part 70 will be described in relation to the configuration in brief.

Referring to FIG. 8, the handle part 60 includes an opening 61 provided at the front wall 53 such that a finger passes through the opening 61 from the outside each of the accommodation containers 50 to the accommodation space 51. A first protrusion part 62 is formed at an upper side of the opening 61 while being protruded toward the accommodation space 51 from the front side wall 53 by a predetermined length such that a user is able to grasp the handle part 60 by the first protrusion part 62.

A second protrusion part 63 is formed at a lower side of the opening 61 while being protruded toward the accommodation space 51 by a protrusion length which is larger than the protrusion length of the first protrusion part 62. The second protrusion 63 makes contact with the food storage container 40 accommodated in the accommodation space 51, so that the food storage container 40 is spaced apart from the front side wall 53.

Such a handle part 60 may be integrally formed with each of the accommodation containers 50 by use of a transformation core, such as a slide code or a rotation core, when each of the accommodation containers 50 is formed.

Similar to the handle part 60, the handle part 70 includes an opening 71 passing through the rear side wall 54 of each of the accommodation containers 50, a first protrusion part 72 formed at an upper side of the opening 71 while being protruded toward the accommodation space 51, a second protrusion part 73 formed at a lower side of the opening 71 while being protrusion toward the accommodation space 51 in a protrusion length larger than that of the first protrusion part 72.

Each of the accommodation containers 50 further includes interval maintaining parts 90 and 91 protruded from the left side wall 55 and the right side wall 56 to an outer side of each of the accommodation containers 50. The interval maintaining parts 90 and 91 have the same heights, and are integrally with each of the accommodation containers 50.

The interval maintaining parts 90 and 91 serve to maintain an appropriate interval between adjacent walls of a plurality of accommodation containers 50 to flow cool air between the plurality of accommodation containers 50. Accordingly, the interval maintaining parts 90 and 91 is provided in various shapes as long as maintaining a predetermined interval among the accommodation containers 50

Figure 9:
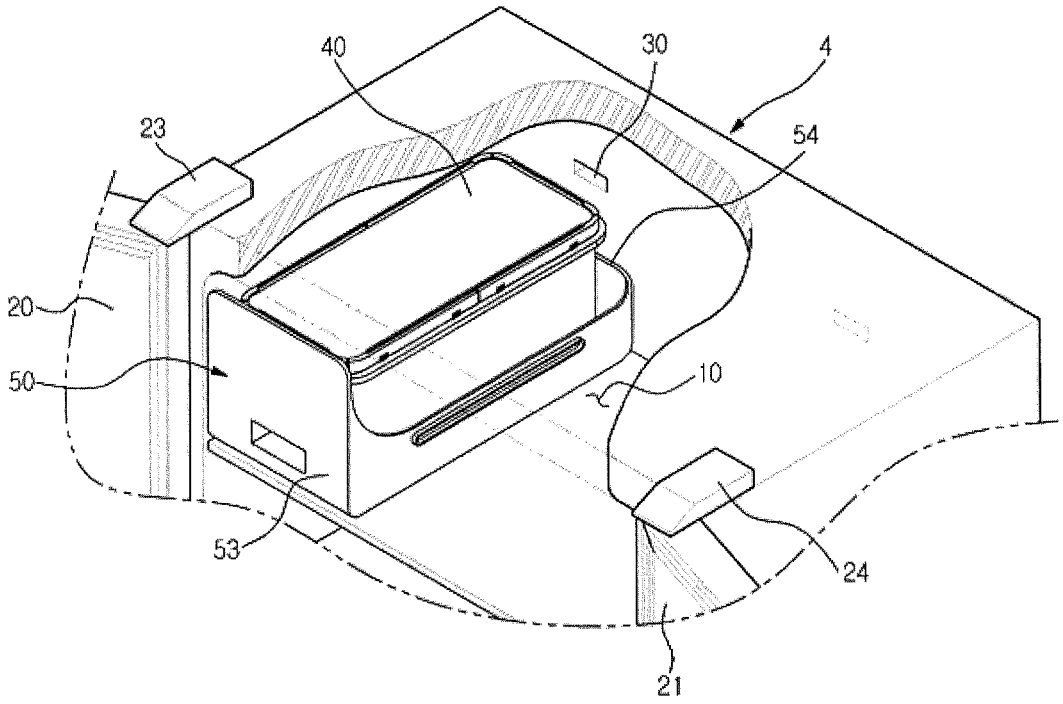
FIG. 9 is a view illustrating a first example of the accommodation container according to an embodiment of the present disclosure.
Figure 10:
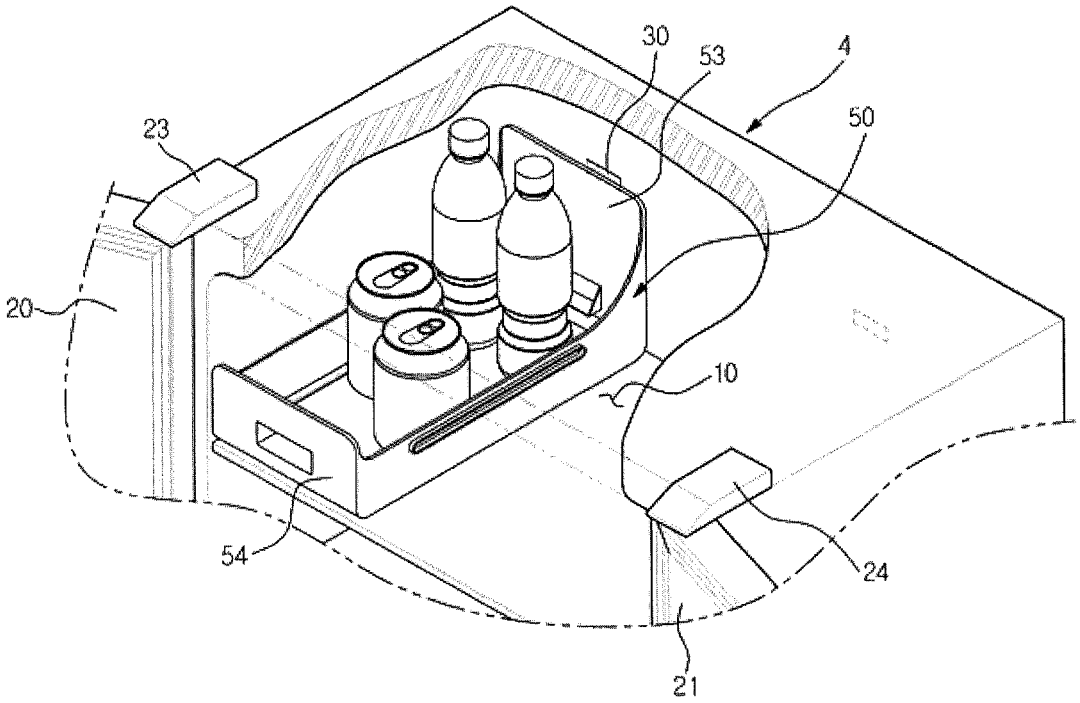
FIG. 10 is a view illustrating a second example of the accommodation container according to an embodiment of the present disclosure.

Referring to FIG. 9, each of the accommodation containers 50, which accommodates the food storage container 40, may have the front side wall 53 disposed at a front side of the storage compartment while having the rear side wall 54, disposed at a rear side of the storage compartment and the height of the front side wall 53 is larger than the height of the rear side wall 54, such that a cool air around the food storage container 40, is prevented from being released to the outside. Alternatively, referring to FIG. 10, the accommodation containers may be placed in the storage compartment by inserting the front side wall 53 first. For example, each of the accommodation containers 50 may have the front side wall 53 disposed at the rear side of the storage compartment while having the rear side wall 54 disposed at the front side of the storage compartment.

In a case that each of the accommodation containers 50 is disposed as shown on FIG. 10, foods, such as cans or bottles, frequently inserted and withdrawn may be accommodated in each of the accommodation containers 50. In this case, the height of the rear side wall 54 is low, so that a user may access the food accommodated in each of the accommodation containers 50 without having to withdraw the accommodation container 50 to an outside the storage compartment 10.

Thereafter, a method of storing foods using the accommodation containers 50 according to the embodiment of the present disclosure will be described. Each of the accommodation containers 50 is able to accommodate a food storage container 40 in which kimchi, vegetables, and fish are hermetically reserved.

The accommodation containers 50 are stored in the storage compartment 10 together with the food storage container 40 accommodated in each of the accommodation containers 50. Even when the doors 20 and 21 are open, a cool air around the food storage container 40 is prevented from being released through the front side wall 53 of each of the accommodation containers 50.

Each of the accommodation containers 50 may have the front side wall 53 disposed at the rear side of the storage compartment 10 and the rear side wall 54 disposed at the front side of the storage compartment 10, and the height of the front side wall 53 is larger than the height of the rear side wall 54. In this case, without having to withdraw the accommodation container 50 from the storage compartment 10, a user easily inputs or withdraws the foods into/from each of the accommodation containers 50.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body having an inner case and an outer case;

a storage compartment provided inside the body and having an open front surface;

a door rotatably coupled to the body to open and close the open front surface;

a food storage container provided in a box shape to store food therein; and an accommodation container accommodated in the storage compartment together with the food storage container while accommodating the food storage container, wherein the accommodation container comprises an accommodation space having an upper surface open, a bottom wall, a front side wall, a rear side wall, a left side wall and a right side wall, the bottom wall, the front side wall, the rear side wall, the left side wall, and the right side wall integrally formed with one another while forming the accommodating space, wherein the front side wall, the rear side wall, the left side wall, and the right side wall are spaced apart from the food storage container to form a space that allows cool air to remain around the food storage container, wherein the front side wall has a height corresponding to a height of the food storage container to prevent the cool air around the food storage container from being released to a front side of the refrigerator, and the rear side wall, the left side wall, and the right side wall have heights lower than the height of the front side wall to allow the cool air to flow around the food storage container, and wherein a front side and a rear side of the accommodation container are reversible such that the front side wall or the rear side wall is disposed at a front side of the storage compartment.

2. The refrigerator of claim 1, wherein the accommodation container further comprises a handle part that is formed at each of the front side wall and the rear side wall in an integral body with the accommodation container to insert and withdraw the accommodation container from the storage compartment.

3. The refrigerator of claim 2, wherein the handle part comprises an opening that connects the accommodation space to an outer side of the accommodation container, a first protrusion part protruding toward the accommodation space from an upper side of the opening, and a second protrusion part protruding toward the accommodation space from a lower side of the opening while having a protrusion length larger than a protrusion length of the first protrusion part.

4. The refrigerator of claim 1, wherein the accommodation container further comprises a lateral side protrusion part that protrudes from each of the left side wall and the right side wall toward the accommodation space to space the food storage container apart from the left side wall and the right side wall, the lateral side protrusion part integrally formed with the accommodation container.

5. The refrigerator of claim 1, wherein the storage compartment is divided into a plurality of partitions by at least one shelf disposed inside the storage compartment, the accommodation container, which is provided in plurality, is stored side by side in at least one of the plurality of partitions of the storage compartment, and the accommodation container further comprises a space maintaining part that protrudes outward from the left side wall and the right side wall to maintain an interval among the plurality of accommodation containers, the space maintaining part integrally formed with the accommodation container.

6. The refrigerator of claim 1, further comprising an outlet that is formed at a rear side of the inner case of the storage compartment to discharge the cool air into the storage compartment, wherein the outlet is configured to discharge the cool air to an upper side of the accommodation container such that the air uniformly moves around the accommodation container by a convection.

7. The refrigerator of claim 1, wherein the accommodation container has the front side wall disposed to face the open front surface of the storage compartment while having the rear side wall disposed to face a rear surface of the storage compartment such that the cool air is prevented from being released to the front side of the accommodation container, or the accommodation container has the front side wall disposed to face the rear surface of the storage compartment while having the rear side wall disposed to face the open front surface of the storage compartment to enable an easy access to the accommodation space of the accommodation container.

8. The refrigerator of claim 1, wherein the door comprises a left side door and a right side door.

9. The refrigerator of claim 1, wherein the accommodation container is formed using transparent material or semi-transparent material.

10. The refrigerator of claim 1, wherein the accommodation container is formed through an injection molding.

11. A refrigerator comprising:

a body having an inner case and an outer case;

a storage compartment provided inside the body and having an open front surface;

at least one shelf disposed in the storage compartment to divide the storage compartment into a plurality of partitions;

a door rotatably coupled to the body to open and close the front surface of the storage compartment;

an accommodation container stored in the plurality of partitions of the storage compartment; and a plurality of outlets provided at a rear side of the inner case of the storage compartment to discharge a cool air into each of the plurality of partitions, the outlet disposed at an upper side of each of the plurality of partitions such that the cool is discharged to an upper side of the accommodation container, wherein the accommodation container includes an accommodation space having an upper surface open, a bottom wall, a front side wall, a rear side wall, a left side wall and a right side wall, and wherein a front side and a rear side of the accommodation container are reversible such that the front side wall or the rear side wall is disposed at a front side of the storage compartment.

12. The refrigerator of claim 11, wherein the accommodation container is provided in a shape of a box having an accommodation space, an upper surface of which is open.

13. The refrigerator of claim 12, wherein the accommodation container comprises a bottom wall, a front side wall, a rear side wall, and lateral side walls that form the accommodation space, and the front side wall has a height larger than heights of the rear side wall and the lateral side walls.

14. A refrigerator comprising:

a body having an inner case and an outer case;

a storage compartment provided inside the body and having an open front surface, and divided by at least one shelf into a plurality of partitions each having a predetermined height;

a door rotatably coupled to the body to open and close the front surface of the storage compartment; and an accommodation container configured to be stored in at least one of the plurality of partitions of the storage compartment, wherein the accommodation container comprises an accommodation space having an upper surface open, a bottom wall, a front side wall, a rear side wall, and lateral side walls, the bottom wall, the front side wall, the rear side wall, and the lateral side walls to form the accommodation space, and wherein the front side wall has a height corresponding to the predetermined height of the plurality of partitions, and the rear side wall and the lateral side walls have heights smaller than the height of the front side wall, and wherein a front side and a rear side of the accommodation container are reversible such that the front side wall or the rear side wall is disposed at a front side of the storage compartment.

15. The refrigerator of claim 14, wherein the height of the front side wall is larger than a half of the predetermined height of the plurality of partitions.

16. The refrigerator of claim 14, wherein the height of the rear wall and the heights of the lateral side walls are smaller than a half of the predetermined height of the plurality of partitions.

* * * * *